United States Patent [19]

Chaudhry

[11] 3,998,310

[45] Dec. 21, 1976

[54] APPARATUS FOR RECORDING DATA IN ARABIC SCRIPT

[75] Inventor: Mohammad Saeed Chaudhry, Southampton, England

[73] Assignee: International Business Machines Corporation, Armonk, N.Y.

[22] Filed: Sept. 24, 1974

[21] Appl. No.: 508,851

[30] Foreign Application Priority Data

Nov. 1, 1973 United Kingdom ..... 50823/73

[52] U.S. Cl. ..... 197/1 A; 178/17 C

[51] Int. Cl.[2] ..... B41J 5/00

[58] Field of Search ..... 197/1 A; 178/17 C

[56] References Cited

UNITED STATES PATENTS 3,513,968 5/1970 Hanson ..... 197/1 A X

*Primary Examiner*—Paul E. Shapiro

*Attorney, Agent, or Firm*—Laurence R. Letson

[57] ABSTRACT

An apparatus for recording data in arabic script is disclosed. Arabic script is written from right to left and characters of arabic script are written in two forms referred to as short form and full form with few exceptions. Each character of the arabic script is stored temporarily in a store before recording. A character having both short and full forms is recorded from the store in short form when followed by another character and in full form when followed by a space.

6 Claims, 7 Drawing Figures

| KHE | HE | CHE | GEEM | SE | TE | TE | PE | BE | ALIF | |
|---|---|---|---|---|---|---|---|---|---|---|
| خ | ح | چ | ج | ث | ٹ | ت | پ | ب | ا | |
| DHAD | SAD | SHEEN | SEEN | ZE | ZE | RE | RE | ZAL | DAL | DAL |
| ض | ص | ش | س | ژ | ز | ڑ | ر | ذ | ڈ | د |
| | | GAF | KAF | QAF | FE | GHAYN | AYN | ZOE | TOE | |
| | | گ | ک | ق | ف | غ | ع | ظ | ط | |
| | | | YE | YE | HA | VA | NOON | MEEM | LAM | |
| | | | ے | ی | ہ | و | ن | م | ل | |

FIG. 1A

| SHEEN | SEEN | KHE | HE | CHE | GEEM | SE | TE | TE | PE | BE |
|---|---|---|---|---|---|---|---|---|---|---|
| ش | س | خ | ح | چ | ج | ث | ٹ | ت | پ | ب |
| MEEM | LAM | GAF | KAF | QAF | FE | GHAYN | AYN | DHAD | SAD | |
| م | ل | گ | ک | ق | ف | غ | ع | ض | ص | |
| | | | | | | | YE | HA | NOON | |
| | | | | | | | ے | ہ | ن | |

FIG. 1B

ف ع ط ص س ر د ح ب ا

ے ی ہ و ل م ل گ ک ق

FIG. 2A

ہ م ر گ ک و ع ص س ح ر

FIG. 2B

| MODERN | PROGRAM | TICKET | FILM |
|---|---|---|---|
| ماڈرن | پروگرام | ٹکٹ | فلم |

FIG 3

APPARATUS FOR RECORDING DATA IN ARABIC SCRIPT

FIELD OF THE INVENTION

The invention relates generally to an apparatus for recording data in an arabic script. The invention has its applications in printers, typewriters, teleprinters, typographical composing machines and data processing systems.

PRIOR ART

An arabic script is written from right to left and languages such as Arabic, Persian and Urdu, which are written in Arabic scripts, have substantially similar rules for building up words.

Characters of arabic script are written in four forms referred to as initial form, medial form, detached form and final form with few exceptions. The initial and medial forms are similar with few exceptions and detached and final forms are also similar with few exceptions. To fit the characters of an Arabic script for processing by machines such as typewriters, they are arranged to be of two forms referred to as a full form and a short form. The initial and medial forms are each classed as the short form and the detached and final forms are each classed as the long form. Some of the characters have full and short forms and some have a full form only. In its application to a typewriter, the Urdu language may be arranged to have 36 full forms of character and in this case provision must be made for typing a total of 60 forms of character. To accomplish this result short forms of character are provided on the lower case and their corresponding long forms of character are provided on the upper case and characters which have no corresponding short forms are also provided on the lower case. Although the keyboard arrangement supplies the complete character set for two forms, the typewriting speed is restricted because the last character in each word must be in full form, the typist must therefore shift into upper case before typing the last character in each word. Thus typing a document in arabic script can be likened to the tedious chore of typing a series of place names in English.

To retain the aesthetic quality of the arabic languages in books and newspapers, typesetting machines must be equipped with all four forms of each character. This problem can be overcome through a large keyboard. But a large keyboard requires a specially-trained operator; the extra keys inevitably slow down the keying speed.

A data processing system requires either two forms or four forms for each arabic character, depending on the application. The use of four forms poses the problem of encoding and decoding about 140 characters. Further the keyboard operators particularly punch card machine operators has the same difficulty as the typist or typesetting machine operator in coping with large keyboards and the case shift for the last character in each word.

OBJECT OF THE INVENTION

It is an object of this invention to provide an improved apparatus for recording data in arabic script.

It is a further object of this invention to provide a keyboard operated machine which provides automatic case shift to record the last character of a word.

It is still a further object of this invention to provide an improved data processing system for processing data in arabic script.

SUMMARY OF THE INVENTION

The foregoing and other objects of the invention are met by providing an improved apparatus for recording data in arabic script. The apparatus according to the invention includes means to store a character having both full and short forms and means to record said stored character in short form when followed by another character and in full form when followed by a space.

The invention also provides an improved apparatus for recording four forms of arabic script.

A data processing system according to the invention includes means to enter data in the form of an input arabic script for processing in a data processing unit to provide a processed output in the form of an output arabic script and the aforementioned apparatus according to the invention for recording the output arabic script from the data processing unit.

The word "space" is hereinbefore and hereinafter referred to as a blank space between adjacent words of the arabic script.

BRIEF DESCRIPTION OF THE INVENTION

FIG. 1A shows Urdu characters in a full form;

FIG. 1B shows Urdu characters in a short form;

FIG. 2A shows basic characters from which the characters shown in FIG. 1A are formed;

FIG. 2B shows basic short characters from which short characters shown in FIG. 1B are formed;

FIG. 3 shows built-up words;

For the purpose of typing, the characters of the Urdu language are written in two forms, full characters and their corresponding short characters with the exception of a few full characters which have no corresponding short characters. Words are built by joining full and short characters, as for example the words FILM and TICKET shown in FIG. 3. The word FILM is a combination of the characters FE, LAM and MEEM. In building the word FILM, the characters FE and LAM are written in short form and the last character MEEM is written in full form. The short forms of the characters FE and LAM are joined in sequence with the last character MEEM to build the word FILM.

The word TICKET is a combination of the characters TE, KAF and TE. The short form of the characters TE and KAF are joined in sequence with the last character TE to build the word "TICKET". The last character is in full form because it is a general rule that the last character of a built-up word is written in full form and all other characters in the built-up words are written in short form with few exceptions.

A further general rule is that the characters ALIF, ḎAL, DAL, ZAL, ŘE, RE, ŽE, ZE, TOE, ZOE and VA are always written as full characters since there are no short forms of these characters. Further when characters ALIF, ḎAL, DAL, ZAL, RE, ŘE, ZE, ŽE and VA are followed by another character in a built-up word, they are not joined with the following character, as for example in the word PROGRAM and MODERN shown in FIG. 3. The word PROGRAM is a combination of the characters PE, RE, VA, GAF, RE, ALIF and MEEM, and the word MODERN is a combination of the characters MEEM, ALIF, DAL, RE and NOON. There are no capital and small letters in the Urdu language.

TYPEWRITER

Figure 4:
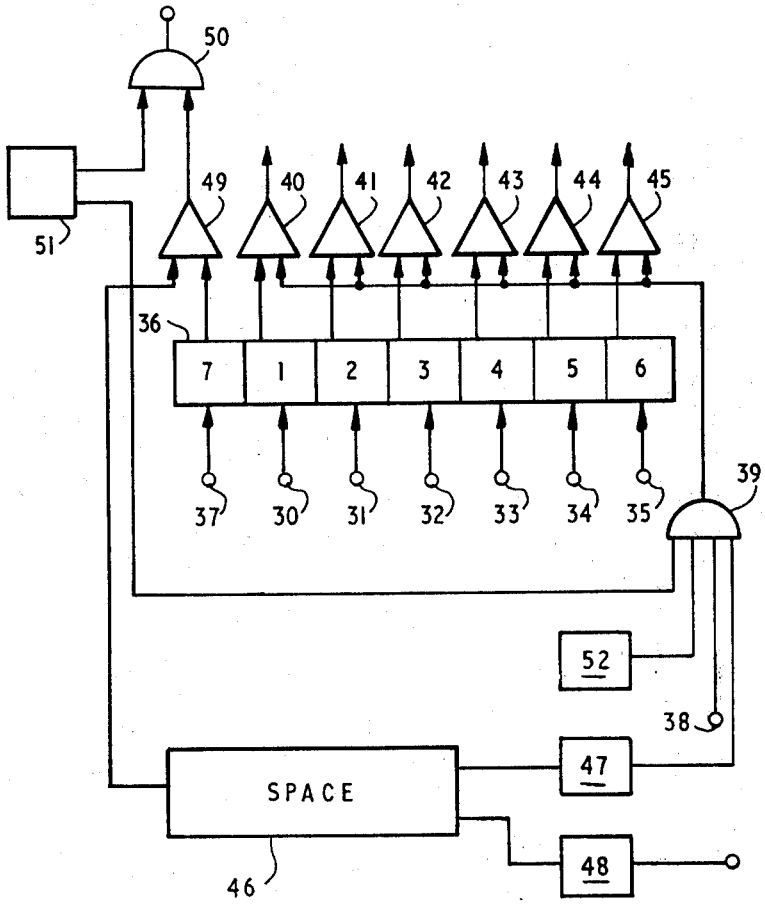
FIG. 4 shows a portion of a typewriter embodying the present invention.

In a typewriter according to the invention, each depression of a character selecting key of the keyboard thereof operates a set of contacts (not shown) to provide a coded combination of six characterselecting pulses which are applied to a character selecting mechanism by means of circuit arrangement shown in FIG. 4. The character selecting mechanism rotates and tilts a single print element bearing type characters to present the selected character for printing. The character selecting mechanism employed in the typewriter according to the invention is of the type well known in the typewriters and teleprinters art.

The keys of the keyboard are so arranged that for a character having a short and a full form, both forms of the character are associated with the same key. The short form is provided on lower case and the full form is provided on the upper case. Each character having a full form only is provided on the lower case.

In FIG. 4 the coded combination of six character selecting pulses are applied to input terminals 30 to 35 for entry to a buffer register 36. The buffer register has six storage stages labelled 1 to 6 for receiving the coded combination of six character selecting pulses and a seventh stage fed from an input terminal 37 for a purpose to be described later.

Upon each depression of a character selecting key of the keyboard therefore, the coded combination of six character selecting pulses are applied to the input terminals 30 to 35 for entry into the buffer register 36. In addition a gating pulse is applied from a contact operated by a universal bail (not shown) to a gate input 38 of an OR gate 39 through which the pulse is supplied to each of six output AND gates 40 to 45. The AND gates 40 to 45 also receive pulses from the stages 1 to 6 respectively of the buffer register 36.

The timing of the gating pulse applied to the AND gates 40 to 45 relative to the entry of the character selecting pulses into the register 36 is such that if initially the register 36 is empty, the gating pulse causes no output from the register 36 through the AND gates 40 to 45 because the gating pulse ceases before the AND gates 40 to 45 can be opened by the stages 1 to 6 of the register 36. The initial character selection therefore causes an entry to be stored in the register 36 of the corresponding coded character selection pulses but no output through the AND gates 40 to 45.

A subsequent character selection causes a repeat of the operation of the universal bail so as to provide a further gating pulse which is applied through the OR gate 39 to each of the AND gates 40 to 45. The initial character selection pulses stored in the register 36 are therefore gated out through the gates 40 to 45 and are applied to the character selecting mechanism for positioning the pring element to print the associated character.

The character currently being selected is meanwhile entered into the register 36 in the manner of the initial character.

The characters selected by the keyboard are entered in series into the register 36 and each is gated out through the gates 40 to 45 upon the selection of the next character. When the last character of a word is stored in the register 36, the space bar 46 included in the keyboard is depressed. The space bar 46 applies a gating signal to the OR gate 39 through a first delay device 47 and applies a spacing signal through a second delay device 48 to operate the spacing mechanism of the typewriter. The delay device 47 has a shorter delay than that of delay device 48 and consequently the character currently stored in the register 36 is gated out to the character selecting mechanism and printed before the spacing caused by the spacing signal from the delay device 48 takes effect.

When the space bar is operated to print the last character of a word, a code representing 'space' may be stored in a store. When a key representing a first character of the next word is operated or the spacing bar 46 is operated again, the code representing the space is gated out to cause spacing movement. In this case the delay element 48 would not be incorporated in the circuit shown in FIG. 4 and the operation of the space bar would only cause the printing of the last character and escapement movement after printing of the last character, but no spacing movement would occur until a key representing a first character of the next word is operated.

Provision is made in the keyboard for each key associated with a character which has both long and short forms to operate a bail (not shown) which causes an associated contact set to provide a pulse which is supplied to the terminal 37 for entry into the seventh stage of the register 36 at the time of entry of the character selecting pulses into the remaining stages of the register 36. A pulse stored in the seventh stage of the register 36 therefore indicates that the character represented in stages 1 to 6 has both full and short forms.

The space bar 46 passes a pulse to an AND gate 49 to gate the pulse, if any, from the seventh stage of the register 36 to an OR gate 50 and thence to the case shift mechanism of the typewriter. If therefore the last character of a word has both long and short forms, the operation of the space bar causes firstly a case shift to prepare for printing the full form of the last character, secondly the printing of the last character, suitably delayed by the delay device 47 to allow time for the case shift to be effected, and thirdly the spacing movement at the end of the word delayed by the delay device 48 to allow time for the caseshift and printing to be completed. If the last character of a word has only one form, no indication is stored for that character in the seventh stage of the register 36 and consequently the space bar 46 does not operate the case-shift but does release the last character for printing and cause a delayed spacing movement.

The escapement distance that occurs after everytime a character is printed may be chosen so that the blank space required between adjacent words is incorporated in the escapement distance that occurs after a last character of a word is printed. In this case also the delay element would not be incorporated into the circuit shown in FIG. 4. The operation of the space bar would only cause the printing of the last character and escapement movement after printing of the last character. Another spacing bar may be provided to achieve spacing movement.

Those characters having one form only can be associated with other characters, such as numerals, which are positioned for printing through the operation of a case shift key 51. The case shift key applies a pulse through the OR gate 50 to operate the case shift mechanism and applies a gating pulse through the OR gate 39 to actuate the gates 40 to 45. Thus to print a selected numeral, the case shift 51 is operated to effect a case shift and to apply the gating pulse through the OR gate 39 to the gates 40 to 45 and thereafter the key corresponding to the selected numeral is actuated and the associated character selecting pulses are entered into the register 36 and gated out through the gates 40 to 45 to the character selecting mechanism.

The keyboard also has a storage disabling key 52 by means of which a signal can be applied through the OR gate 39 to open the AND gates 40 to 45. By using the key 52 the storage effected by the register 36 is disabled and each selected character can be printed immediately following its selection if desired.

Dead keys may be provided for printing certain of the Symbols required for the script as required without escapement in a manner well known per se.

KEYBOARD

Example I

On the lower cases are arranged the short characters shown in FIG. 1B, and the full characters ALIF, ḎAL, DAL, ZAL, RE, ṚE, ZE, ẒE, TOE, ZOE and VA.

On the upper case are provided the characters shown in FIG. 1A. except for those having no corresponding short form, and the numbers. The characters AYN and GHAYN come in a special category because for each of these two characters the initial, medial, detached and final forms are retained. The initial and medial forms are each classed as a short form and the detached and final forms are each classed as a full form. The characters AYN and GHAYN each have on one key the initial (short) form and the detached (full) form and on another key the medial (short) form and the final (full) form.

Symbols such as ZABAR, ZER and PESH are provided on dead keys.

Example II

The characters shown in FIGS. 1A and 1B are made up from the basic characters shown in FIGS. 2A and 2B. For example the character BE is formed by adding a single dot below the character 2 shown in FIG. 2A and the character SE is formed by adding three dots above the character 2 shown in FIG. 2A.

The short characters shown in FIG. 2B, the full characters shown in FIG. 2A which have no corresponding short characters, the symbols to modify the basic characters to form characters shown in FIG. 1 are provided on the lower case.

The basic characters shown in FIG. 2A except those which have no corresponding short characters and numbers are provided on the upper case.

Symbols such as ZABAR, ZER and PESH are provided on dead keys.

Control Unit for Machines for Recording and Transmitting Data in Arabic Script.

Punch card machines, punch tape machines and magnetic recording machines are provided to record coded data in arabic script. Those machines are similar to the machines for recording data in the Roman alphabet. Each character has its own code and no distinction is made between the short and full form of a character. The recorded data is then entered into a computer by an input device such as a card reader, a punch tape reader or a magnetic tape reader. The data in arabic script may then be processed in the data processing system in the same manner as data in the Roman alphabet. An output device such as an output printer is provided to print the result of processing the data under the control of a control unit to be described hereinafter, with reference to FIG. 5 of the accompanying drawings. A tape punch or magnetic recording machine may be used in place of the output printers in which case the punched or magnetically recorded characters may be accompanied by a code to distinguish between the short and full form of a character.

The input source 1, may be a computer, or data processing device adapted to generate a series of bits indicative of data to be recorded. In the present system a binary code of six bits plus a seventh bit for checking is used, but other codes may be employed. Each stage of a multistage timing ring 2 has an output conductor 3 connected to one input of a gating AND circuit 4 having an output conductor 5 connected to a corresponding stage of a single character register 6. Each stage of the register 6 has an output conductor 7 connected to one input of a second gating AND circuit 8 having an output conductor 9 connected to a corresponding stage of another single character register 10. Each stage of the register 10 has an output conductor 11 connected to one input of a third gating AND circuit 12 having an output conductor 13 leading to a decoder matrix 14. Each output conductor 7 of the register 6 is connected to a gating AND circuit 15 through an inverter 22. An output conductor 16 of the gating AND circuit 15 is connected to one input of a gating AND circuit 17 having an output conductor 18 leading to the decoder matrix 14. An input conductor 19 to the first stage of the timing ring 2 is connected to a starting device (not shown) in the form of a clock circuit which is a part of or under the control of the data source 1. A data signal output conductor 20 from the data source 1 is connected to all the gating AND circuits 4. The timing ring 2 is a free-running, open-ended ring in which each stage is connected to a successive stage so that a start pulse delivered to the first stage starts the ring running so that each stage switches its following stage to deliver signal pulses in successive steps to the gating AND circuits 4 and the running of the timing ring 2 terminates with the switching of the last stage. The pulsing of the first stage of the timing ring 2 by the start device of the date source 1 occurs as the first bit of a data signal is sent to the first group of gating AND circuits 4 and switching of the successive stages of timing ring 2 in accordance with its free running characteristic occurs in synchronism with the generation of the succeeding bits from the data source 1. The last stage of the timing ring has a second output 21 connected to all the AND circuits 8, 12 and 17.

A start pulse from the data source 1 on the conductor 19 starts the cycle of the timing ring 2. Coincidently with the start pulse on the conductor the first bit of the coded data is sent on the conductor 20 to the first input AND gate 4. If the first bit is a pulse, a concident pulse from the first stage of the ring 2 on the conductor 3 will cause a pulse from the corresponding AND gate 4 on conductor 5 to switch the first stage of the register 6. As the timing ring 2 steps along, the bits of the data are applied along the conductor 20 to the AND gates 4. When pulses from a stage of the ring 2 and from the conductor 20 are applied coincidently to a gate 4, the corresponding stage of the register 6 is switched. As each stage of the register 6 is switched, the output conductors 7 to the AND gates 8 are energised. The conductors 7 remain energised until the timing ring 2 has completed its cycle and the last stage has been switched. When that occurs, the conductor 21 is energised and those AND gates 8 having energised input conductors 7 give an output on the conductor 9 to the Register 10. Thus a character stored in the register 6 is transferred to the register 10. Similarly the character stored in the register 10 is transferred to the decoder matrix 14.

Each of the output conductors is connected to a decoder so that when a space is stored in the register a conductor 16 is energised. Each of the output conductors 7 is connected to the AND gate 15 through the inverter 22, so that when a space is stored in the register 6, none of the conductors 7 is energised, whereby the output conductor 16 is energised. When a space appears in the register 6, it is desired to record or transmit the character stored in the register 10, in its full form. The conductor 16 remains energised until the conductor 21 is energised. When that occurs, the AND gate 17 gives an output on the conductor 18 to the decoder matrix, together with the outputs of the AND gates 12. The supply of this extra output to the decoder matrix with the transfer of a character from the register 10 to the decoder matrix gives an indication that the character is to be recorded or transmitted in its full form.

In this case also the space code may not cause any spacing movement after escapement movement following the printing of the last character of a word.

Figure 5:
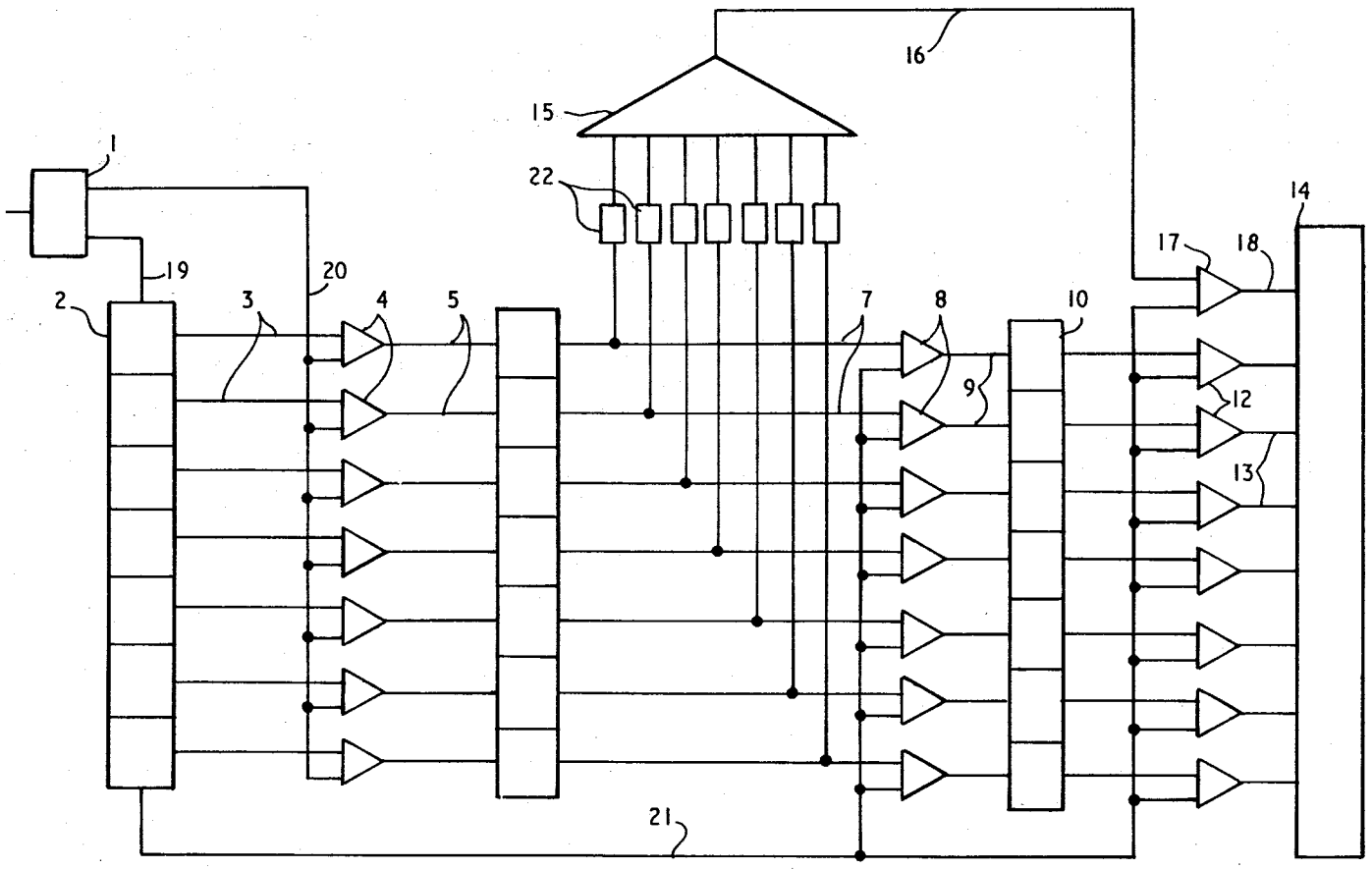
FIG. 5 illustrates a control unit for machines for recording or transmitting data in an Arabic script according to the present invention.

The control unit shown in FIG. 5 can be modified to record or transmit a character in initial, medial, detached or final form. A decoder (not shown) is connected to the outut conductors 13 of the AND gates 12. The decoder is adapted to provide a pulse when a space or a character which cannot be attached to the following character in a word is gated out through the AND gates 12 to the decoder matrix 14. The decoder (not shown) is connected to an extra storage stage (not shown) provided in the register 10 and an output conductor from the extra storage stage is connected to one input of an AND gate (not shown) having an output conductor (not shown) leading to the decoder matrix 14, the second input of the AND gate being connected to the conductor 21. When a character having four forms is stored in the register 10 and a pulse is stored in said extra storage stage of the register 10, the character stored in the register 10 is transferred to the decoder matrix to record or transmit it in initial form when another character is stored in the register 6 and in detached form when a space is stored in the register 6. When there is no pulse stored in said extra stage of the register 10, the character stored in the register 10 is transferred to the decoder matrix to record or transmit it is medial form when another character is stored in the register 6 and in final form when a space is stored in the register 6.

In a transmission system including teleprinters according to the invention, characters of arabic script are transmitted without any distinction between short and full form and both at the sending station and the receiving station a character having both short and full forms is recorded in short form when followed by another character and in full form when followed by a space. The invention can also be embodied in typewriters or teleprinters in which characters are recorded in initial, medial, detached and final forms. Further the invention can be embodied in machines for setting arabic types.

While the invention has been particularly shown and described with reference to the preferred embodiments thereof, it will be understood by those skilled in the art that various changes in form and details may be made therein without departing form the spirit and scope of the invention.

What I claim is:

1. A typewriter for typing Arabic script comprising a keyboard, a character-selection mechanism, a case shift mechanism, a store through which the characters of the script can be passed for typing after entry from the keyboard, means to generate a universal gating signal on operating each character key, a gating arrangement controlled by said universal gating signal to gate the stored character out of each store to said character selection mechanism, means effective for each character having both full and short forms to supply an indication to this effect whereby characters having both full and short forms are distinguished from characters having full form only, a gate controlled by said indication, means effective in respect of each character having both full and short forms to cause the typing thereof from the store in short form when followed by a character and in full form when followed by a space, and a space bar operable to generate a signal through said gate for operating said case shift mechanism, whereby, when said indication is present, said case shift mechanism is operated and the stored character is typed in full form.

2. A typewriter according to claim 1, wherein the keyboard has a case shift key effective when actuated both to generate said gating signal and to operate said case shift mechanism.

3. A typewriter for typing Arabic script, comprising a keyboard, a character-selection mechanism, a store through which the characters of the script can be passed for typing after entry from the keyboard, means to generate a universal gating signal on operating each character key, a gating arrangement controlled by said universal gating signal to gate the stored character out of said store to said character selection mechanism, a key capable of generating said gating signal independently of the entry of characters for typing, and means effective in respect of each character having both full and short forms to cause the typing thereof from the store in short form when followed by a character and in full form when followed by a space.

4. A keyboard-operated machine for recording data in Arabic script comprising a keyboard, a character-selection mechanism, a case shift mechanism, a store through which the characters of the script can be passed for typing after entry from the keyboard, means to generate a universal gating signal on operating each character key, a gating arrangement controlled by said universal gating signal to gate the stored character out of each store to said character-selection mechanism, means effective for each character having both full and short forms to supply an indication to this effect whereby characters having both full and short forms are distinguished from characters having full form only, a gate controlled by said indication, means effective in respect of each character having both full and short forms to cause the typing thereof from the store in short form when followed by a character and in full form when followed by a space, and a space bar operable to generate a signal through said gate for operating said case shift mechanism, whereby, when said indication is present, said case shift mechanism is operated and the stored character is typed in full form.

5. A keyboard-operated machine according to claim 4, wherein the keyboard has a case shift effective when actuated both to generate said gating signal and to operate said case shift mechanism.

6. A keyboard-operated machine for recording data in Arabic script comprising a keyboard, a character-selection mechanism, a store through which the characters of the script can be passed for typing after entry from the keyboard, means to generate a universal gating signal on operating each character key, a gating arrangement controlled by said universal gating signal to gate the stored character out of said store to said character selection mechanism, a key capable of generating said gating signal independently of the entry of characters for typing, and means effective in respect of each character having both full and short forms to casue the typing thereof from the store in short form when followed by a character and in full form when followed by a space.

* * * * *